United States Patent [19]

Simson et al.

[11] 4,450,875

[45] May 29, 1984

[54] CONTROL DEVICE FOR THE NOZZLES OF A JET INSERTION POWER LOOM

[75] Inventors: Dionizy Simson, Winterthur; Hansjörg Walch, Seuzach, both of Switzerland

[73] Assignee: Sulzer Brothers Ltd., Winterthur, Switzerland

[21] Appl. No.: 307,618

[22] Filed: Oct. 1, 1981

[30] Foreign Application Priority Data

Oct. 2, 1980 [EP] European Pat. Off. ..... 80 105967.6

[51] Int. Cl.[3] ..... D03D 47/30

[52] U.S. Cl. ..... 139/435; 137/624.18

[58] Field of Search ..... 139/435; 226/97; 137/624.18, 624.2; 251/175

[56] References Cited

U.S. PATENT DOCUMENTS

| | | | |
|---|---|---|---|
| 3,307,579 | 3/1967 | Beddoes | 137/624.18 |
| 3,399,698 | 9/1968 | Bentley | 137/624.2 |
| 3,426,973 | 2/1969 | Ordway | 137/624.18 |
| 4,245,677 | 1/1981 | Suzuki | 139/435 |
| 4,263,937 | 4/1981 | Rudenko | 137/624.18 |

*Primary Examiner*—Henry Jaudon

*Attorney, Agent, or Firm*—Kenyon & Kenyon

[57] ABSTRACT

The drum-shaped control device has a jacket which defines an air pressure reservoir and outlets which connect via air feed lines to the nozzles of the weft insertion device. A split rotary slide valve is disposed within the jacket so as to open each of the outlets in sequence to the pressurized air in the reservoir. The valve is driven by a hollow tubular shaft which is connected via pins to the valve. Air is delivered to the reservoir through the hollow shaft from one end of the control device. Operation of the moving parts during operation is compensated by the widening of the split valve due to the pressure in the reservoir.

13 Claims, 5 Drawing Figures

CONTROL DEVICE FOR THE NOZZLES OF A JET INSERTION POWER LOOM

This invention relates to a control device for the nozzles of a jet insertion power loom, and particularly to an air jet loom.

Heretofore, various air jet power looms have been provided with a moving field and so-called auxiliary nozzles arranged along a weft thread path in order to insert a weft thread into a shed. In order to control the manner in which pressurized air is delivered to these nozzles, use has been made of various control devices. One such control device, as described in German O.S. No. 21 45 256, employs a rotary slide valve of disk form which rotates on a shaft and is arranged in a pressure chamber to cover a base plate of the pressure chamber containing a plurality of air outlets to which the nozzles are connected. The valve has an opening which extends over several of the outlets so that as the disk rotates, one or more outlets are uncovered.

However, a difficulty with the above control device is that the rotary slide valve slides over the base plate. Thus, sealing between the valve and plate can become impaired. In particular, the outer points of the rotary slide valve can show more abraison, due to the greater radius, than the inner points. This may result in uneven sealing at the outer and inner points of the rotary slide valve during operation. Consequently, the uneven abraison cannot be readily compensated during the operation of the disk-shaped rotary slide valve.

Furthermore, the number of nozzles than can be connected to the pressure chamber of the above control device is limited. Thus, the control device is not suitable for power looms with a high weaving width and numerous auxiliary nozzles.

Accordingly, it is an object of the invention to provide a control device for a plurality of weft insertion nozzles which operates with a minimum of abraison between moving parts.

It is another object of the invention to provide a control device for supplying air to a relatively large number of weft insertion nozzles.

It is another object of the invention to provide for a reliable seal between the moving valve parts of a control device for a plurality of nozzles.

Briefly, the invention provides a control device for a plurality of weft insertion nozzles, for example in a jet power loom. The control device is comprised of a stationary drum shaped reservoir having a plurality of circumferentially disposed outlets and a cylindrical slide valve which is rotatably mounted in the reservoir. This slide valve is provided with a slit or gap which extends over the length of the valve so that the valve is radially deformable. This split construction allows the cylindrical valve to be placed under a slight initial stress in the radial direction at the start of an operation. Alternatively, a slight radial stress can be placed on the split valve during operation due to the pressure of a pressure medium in the reservoir.

The radial stressing of the valve insures that the cylindrical valve always runs under full tightness or sealing action on the inner circumference of the drum shaped reservoir. Thus, even when the parts are gradually worn out by abrasion, there is automatically sufficient tightness to avoid leakage losses.

The control device also allows those air outlets of the pressure reservoir which connect with the nozzles which are to generate a blast of pressure medium, for example during an entire weft insertion, to be supplied with the pressure medium through a simple by-pass channel for a longer time than other nozzles in the weft insertion path not provided for this purpose.

These and other objects and advantages of the invention will become more apparent from the following detailed description taken in conjunction with the accompanying drawings wherein.

Figure 1:
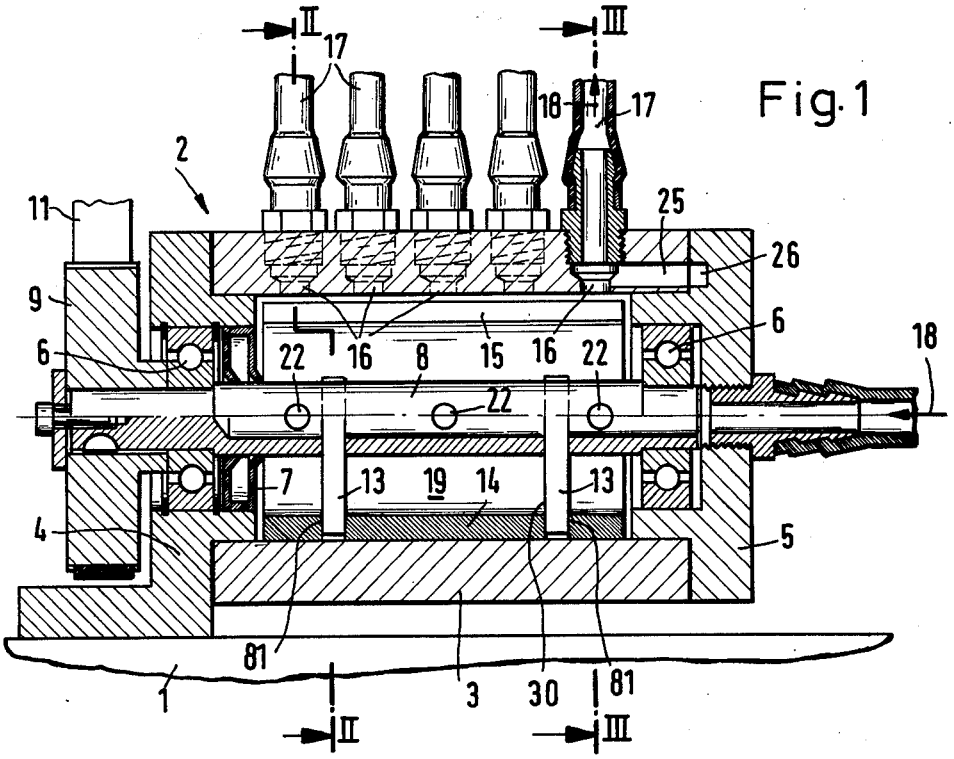
FIG. 1 illustrates a longitudinal sectional view through a control device according to the invention.
Figure 2:
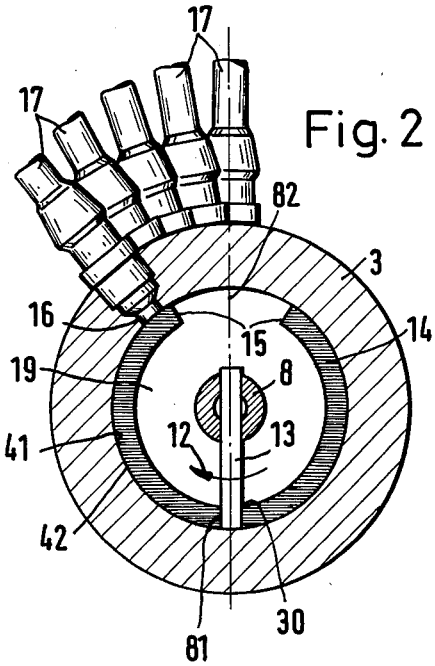
FIG. 2 illustrates a view taken on line II—II of FIG. 1.

Referring to FIG. 1, a control device for a plurality of weft insertion nozzles (not shown) of a jet power loom, such as an air jet loom, is mounted on a frame 1 of the loom. The control device includes a stationary drum shaped reservoir 2 which is formed by a cylindrical jacket 3 and a pair of disk-shaped covers 4, 5 which are attached at the respective ends of the cylinder 3. The cylindrical jacket 3 serves to define a pressure medium receiving reservoir 19 and is provided with a plurality of circumferentially disposed outlets 16. As indicated in FIG. 2, the outlets 16 are arranged in a helical manner for connection to the nozzles (not shown) of the jet power loom via lines 17.

In addition, the control device includes a cylindrical slide or spool valve 14 which is rotatably mounted in the jacket 3. As indicated in FIG. 2, the valve 14 is made in the manner of a split sleeve with a slit or gap 15 defined by the respective longitudinal edges. The valve 14 is disposed within the jacket 3 so as to selectively close the outlets 16 to the pressure medium with the reservoir 19.

The control device also has a means for supplying a pressure medium, such as air, into the jacket 3 in order to bias the valve 14 radially against the jacket 3. In addition, means are provided for rotating the valve 14 within the jacket 3 in order to selectively communicate the outlets 16 with the reservoir 19 through the slit 15 in the valve 14.

As shown in FIG. 1, the means for rotating the valve 14 includes a tubular shaft 8 which is located coaxially within the valve 14 and jacket 3 and is coupled to the slide valve 14 via a plurality or radially disposed pins 13 for simultaneous rotation. The shaft 8 is journalled in suitable bearings, such as ball bearings 6, disposed within the respective covers 4, 5 while a gasket 7 is provided near one end for sealing purposes. The shaft 8 carries a toothed gear or disk 9 at one end which cooperates with a toothed drive belt 11. The belt 11 serves to drive the shaft 8 in synchronism with the main shaft of the power loom in a direction indicated by the arrow 12 in FIG. 2. As indicated in FIG. 1, the gear 9 is held to the shaft 8 via a suitable washer and bolt assembly.

The shaft 8 is hollow at the end opposite the gear 9 and has a plurality of radial openings 22 communicating the interior of the shaft 8 with the reservoir 19. The means for supplying the pressure medium into the jacket 3 includes a nozzle which is fixed in the cover 5 and communicates with the hollow end of the shaft 8 in order to deliver a pressure medium thereto in the direction indicated by the arrow 18.

As indicated in FIG. 2, the slide valve 14 extends over an angle of about 280° within the cylindrical jacket 3. In addition, each pin 13 protrudes in the center 30 of the circumferential sector of the valve 14, for example into a bore 81 disposed opposite the center 82 of the slit 15 with little play to permit movement of the valve 14 in a radial direction. As indicated, the slit extends in parallel axial relation to the axis of the shaft 8.

During operation, compressed air is introduced in the direction indicated by the arrow 18 into the tubular shaft 8. The compressed air then enters through the openings 22 into the reservoir 19. At this time, the pressurized air forces the split valve 14 constantly against the inner circumferential surface 41 of the jacket 3 by slightly expanding the valve 14. The valve 14 is thus able to slide via the outer circumferential surface 42 in a sealed manner on the jacket surface 41. During this time, the shaft 8 is rotating so that the slit 15 of the valve 14 runs successively over the helically arranged outlets 16 in the jacket 3 such that the lines 17 are successively fed with air.

Because of the construction of the split valve 14, should any wear occur between the valve 14 and the jacket 3, the valve 14 still bears evenly on the cylinder 3 due to the pressure in the chamber 19. Of note, the nozzles which are connected to the lines 17 may be so called auxiliary nozzles which are arranged along the insertion path of a weft thread being picked into the loom. These nozzles carry the respective thread tip further in the direction of the insertion path.

Figure 3:
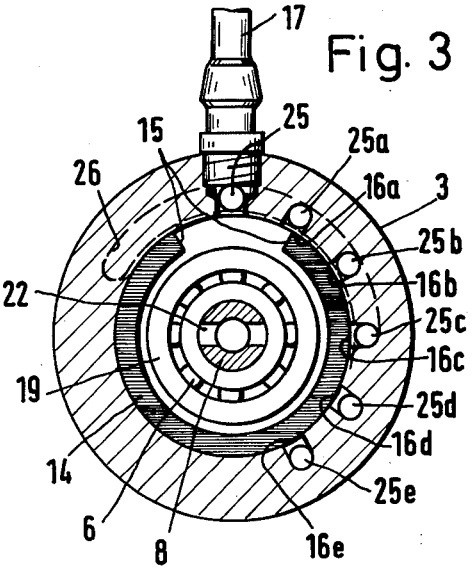
FIG. 3 illustrates a view taken on line III—III of FIG. 1.
Figure 4:
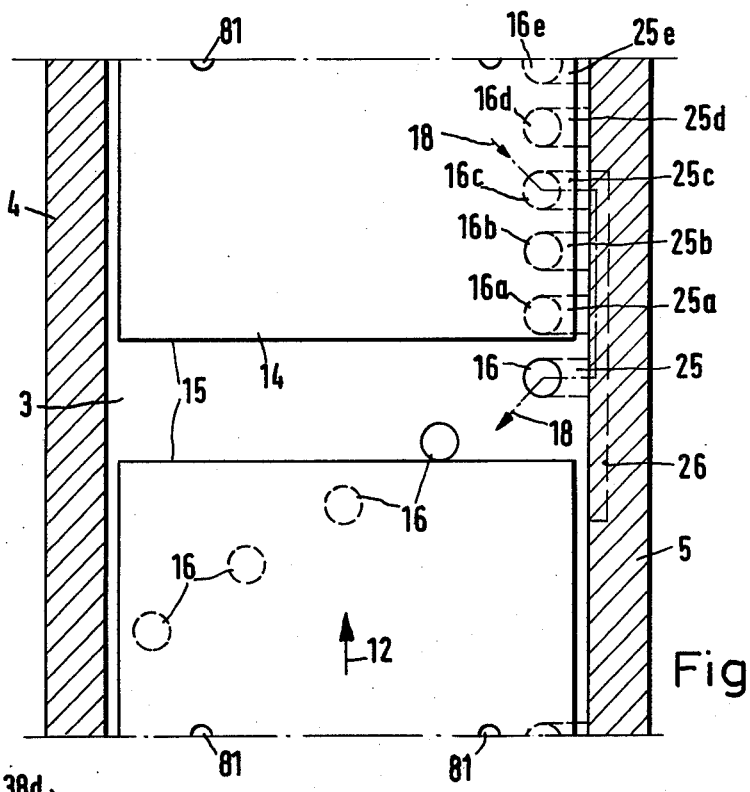
FIG. 4 illustrates a development of the inner circumferential surface of the pressure reservoir of FIG. 1.

Referring to FIGS. 3 and 4, the jacket 3 is provided with a plurality of parallel coaxial bores **25–25*e*. One bore 25 communicates with the outlet 16 whereas the remaining bores 25*a*–25*e* communicate with the reservoir 19 via auxiliary outlets 16*a*–16 *e*. In addition, the cover 5 contains a by-pass channel 26 which extends in arcuate manner, for example over an angle of about 160°. As indicated in FIG. 3, the by-pass channel 26 is disposed at the ends of the bores 25. By turning the cover 5, the by-pass channel 26 can be placed over a selected number of bores 25–25*e*. As shown in FIG. 3, the by-pass channel 26 is opposite the bores 25, 25*a*, 25*b*, 25*c* so that these bores are connected with each other by the by-pass channel 26**.

As indicated in FIG. 4, the valve slit 15 is of a width larger than the circumferential distance between the axes of two adjacent outlets 16 to permit delivery of air to more than one nozzle simultaneously.

Figure 5:
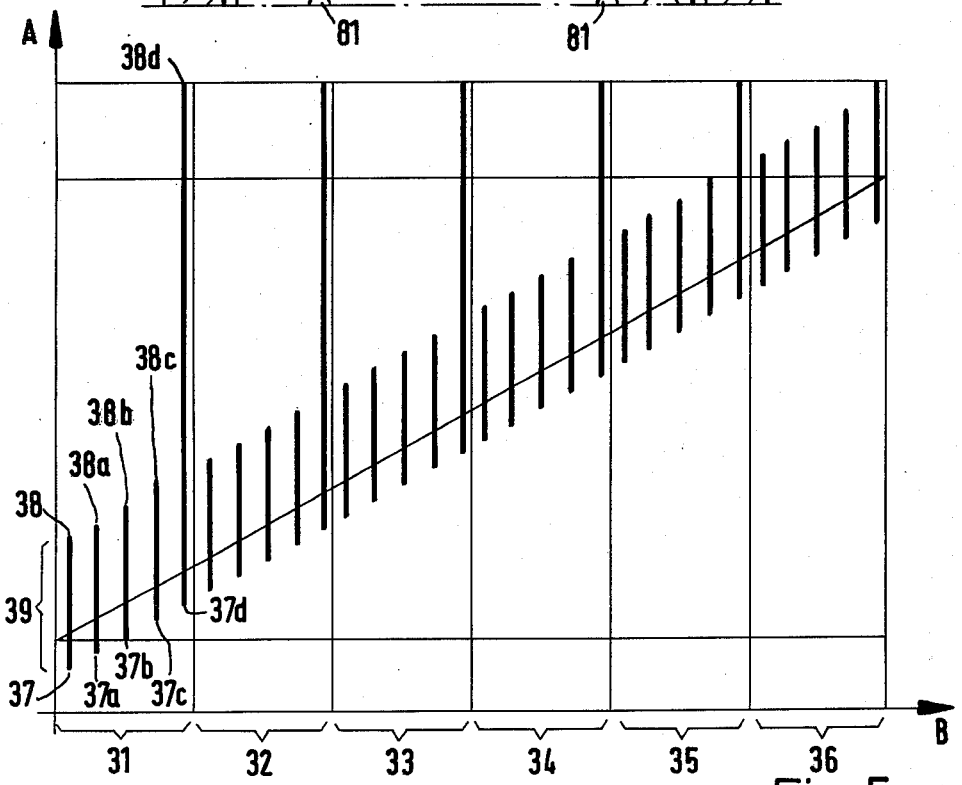
FIG. 5 diagrammatically illustrates a control program for the control device.

For the operation according to FIG. 5, it is assumed that six control devices 31–36 according to FIGS. 1 to 4 are arranged along the weaving width of the power loom. The weaving width is indicated along the axis B. In each control device, the first four air feed lines 17 are connected to the first four nozzles of the weft insertion device. In addition, these air feed lines 17 receive air from the opening time 37, **37*a*, 37*b*, 37*c* to the respective closing times 38, 38*a*, 38*b*, 38*c*. Thus, each blows air in the period designated 39. This time period is equal for each of the four nozzles. The remaining air feed line 17 as indicated on the right in FIG. 1, however receives air from the air opening time 37*d* to the closing time 38*d*** which corresponds to the end of the weft insertion time and the angle of rotation of the main shaft of the power loom. The time is indicated on the axis A.

The remaining control devices 32–36 are programmed in a simmilar manner.

During operation, there is a corresponding course of the blast air at the respective nozzles via the control devices 31–36; however, the respective blast profile for the nozzles is somewhat later than in the preceeding control device.

In order to effect the longer blast time via the right-hand air feed line 17, the outlet 16 of the line 17 is communicated with the axial bores **25*a*–25*e* via the by-pass channel 26 and bore 25. By turning the cover 5 and varying the position of the by-pass channel 26, the blast time for the last nozzle controlled by the individual control devices 31–36** can be varied from time to time.

It is to be noted that if abrasion appears on the contact surfaces 41, 42 of the jacket 3 and valve 14 after prolonged operation, the valve 14 is somewhat widened automatically by the pressure in the chamber 19 and by the centrifugal force of the valve 14. Thus, the valve 14 runs constantly with the contact surface 42 tight on the surface 41 of the cylinder 3.

In a modified embodiment, the rotary slide valve 14 may be initially stressed so that the outer surface of the valve 14 bears against the inner surface 41 of the jacket 3 with an initial stress during assembly.

The rotary slide valve 14 may be made of any suitable material such as plastic so that the parts can run on each other without lubrication. The air and auxillary nozzles as well as the weft threads and fabrics thus remain free of lubricant.

The number of control devices used over a weaving width B can also be more than the number illustrated. Further, each individual control device may have more than five connecting lines 17 for five nozzles. Also, it is possible to connect each air feed line 17 to a multiplicity of nozzles, for example three, so that each receives air at the same time.

It is to be noted that a control device such as described in FIGS. 1–4 can also be used to control a so-called main insertion nozzle arranged on the weft side of the loom outside the shed.

It is to be noted that the slit 15 and the rotary slide valve 14 need not be completely parallel to the shaft 8. For example, the slit 15 may also be arranged in a helical manner. Further, the slit 15 may extend in the sense of the helical form of the arrangement of the outlets 16 but with a different inclination or in the opposite direction. Also, the width of the slit 15 can vary.

The invention thus provides a control device for a plurality of weft insertion nozzles which can automatically adjust to wear. Further, the control device may be used with a relatively large number of weft insertion nozzles.

The invention further provides a control device in which leakage losses are avoided. Further, where the slide valve is made of a self-lubricating material such as a plastic, oil-free air may be delivered to the weft insertion nozzles so that there is no danger of lubrication being injected with the weft thread into the fabric being woven.

What is claimed is:

1. A control device for a plurality of weft-insertion nozzles in a jet power loom comprising a stationary drum shaped reservoir having a plurality of circumferentially disposed outlets arranged in a helical manner for connection to the nozzles of a jet power loom; and a cylindrical slide valve rotatably mounted in said reservoir, said valve having a slit extending over the entire length of said valve and of a width greater than the circumferential distance between the axes of two adjacent outlets.

2. A control device as set forth in claim 1 which further comprises a tubular shaft coupled to said slide valve for rotation therewith, said shaft having at least one opening communicating with said reservoir for supplying a pressure medium thereto.

3. A control device as set forth in claim 2 in which said shaft has an axial bore communicated with said opening in said shaft and adapted to be communicated with a pressure medium supply line.

4. A control device as set forth in claim 2 which further comprises at least one radial element connecting said shaft with said valve.

5. A control device as set forth in claim 4 wherein said valve is coupled with said connecting element for movement in a radial direction.

6. A control device as set forth in claim 1 which further comprises at least one bore communicating with said reservoir and spaced from said outlets and a bypass channel connecting said bore with one of said outlets.

7. A control device for a plurality of of weft insertion nozzles comprising a jacket defining a pressure medium receiving reservoir and having a plurality of circumferentially disposed outlets arranged in a helical manner;

a cylindrical slide valve rotatably mounted in said jacket and having a longitudinal slit extending over the entire length of said valve and being of a width greater than the circumferential distance between the axes of two adjacent outlets to selectively close said outlets to said reservoir;

first means for supplying a pressure medium into said jacket to bias said valve radially against said jacket; and second means for rotating said valve within said jacket to selectively communicate said outlets with said reservoir through said slit in said valve.

8. A control device as set forth in claim 7 wherein said second means includes a rotatable shaft extending coaxially within said valve and at least one radially disposed pin securing said valve to said shaft for rotation therewith.

9. A control device as set forth in claim 8 wherein said shaft is hollow at at least one end and has a plurality of openings communicating the interior of said shaft with said reservoir and wherein said first means includes a nozzle communicating with said end of said shaft to deliver a pressure medium thereto.

10. A control device as set forth in claim 7 wherein said slit is parallel to a longitudinal axis of said valve.

11. A control device for a plurality of weft-insertion nozzles in a jet power loom comprising a stationary cylindrical jacket defining a drum shaped reservoir having a plurality of circumferentially disposed outlets arranged in a helical manner for connection to the nozzles of a jet power loom, a cover secured to said jacket, a plurality of axial parallel bores in said jacket communicating with said reservoir, and a by-pass channel in said cover connecting at least one of said bores with one of said outlets; and a cylindrical slide valve rotatably mounted in said reservoir, said valve having a slit extending over the length of said valve.

12. A control device for a plurality of weft insertion nozzles comprising a jacket defining a pressure medium receiving reservoir and having a plurality of circumferentially disposed outlets;

a cylindrical slide valve rotatably mounted in said jacket and having a longitudinal slit to selectively close said outlets to said reservoir;

first means for supplying a pressure medium into said jacket to bias said valve radially against said jacket;

second means for rotating said valve within said jacket to selectively communicate said outlets with said reservoir through said slit in said valve; and a cover at one end of said jacket, a plurality of parallel coaxial bores in said jacket communicating with said reservoir, one of said bores communicating with one of said outlets, and a bypass channel in said cover selectively connecting at least some of said bores together and with said one bore, whereby upon rotation of said valve, said slit opens said some of said bores to said reservoir to permit delivery of pressure medium to said one outlet over an extended period of time.

13. A control device for a plurality of weft-insertion nozzles in a jet power loom comprising a stationary drum shaped reservoir having a plurality of circumferentially disposed outlets arranged in a helical manner for connection to the nozzles of a jet power loom;

a cylindrical slide valve rotatably mounted in said reservoir, said valve having a slit extending over the length of said valve;

a tubular shaft coupled to said slide valve for rotation therewith, said shaft having at least one opening communicating with said reservoir for supplying a pressure medium thereto; and at least one radial element connecting said shaft with said valve, said element being connected with said valve diametrically opposite said slit.

* * * * *